US006918818B2

(12) United States Patent
Rüdiger

(10) Patent No.: US 6,918,818 B2
(45) Date of Patent: Jul. 19, 2005

(54) POLISHING METHOD

(75) Inventor: Böhm Rüdiger, Untermerzbach (DE)

(73) Assignee: Rosler Oberflachentechnik GmbH, Bad Staffelstein (DE)

( * ) Notice: Subject to any disclaimer, the term of this patent is extended or adjusted under 35 U.S.C. 154(b) by 0 days.

(21) Appl. No.: 10/394,910

(22) Filed: Mar. 20, 2003

(65) Prior Publication Data

US 2003/0216110 A1 Nov. 20, 2003

(30) Foreign Application Priority Data

May 16, 2002 (DE) ..... 102 21 842

(51) Int. Cl.[7] ..... B24B 1/00
(52) U.S. Cl. ..... 451/36; 451/113; 451/106
(58) Field of Search ..... 451/36, 32, 34, 451/35, 37, 74, 326, 327, 328, 329, 104, 113, 105

(56) References Cited

U.S. PATENT DOCUMENTS

| | | | | |
|---|---|---|---|---|
| 2,854,222 A | | 9/1958 | Dening, et al. | |
| 3,516,203 A | | 6/1970 | Hambright | |
| 3,566,522 A | | 3/1971 | Hambright | |
| 3,566,552 A | | 3/1971 | Hambright | |
| 4,173,851 A | | 11/1979 | Higashi | |
| 5,857,901 A | * | 1/1999 | LaPoint | 451/113 |
| 6,406,356 B1 | * | 6/2002 | Brooks | 451/36 |
| 6,572,458 B2 | * | 6/2003 | Lim | 451/113 |

FOREIGN PATENT DOCUMENTS

| | | |
|---|---|---|
| DE | 26 20 477 A1 | 11/1977 |
| DE | P3332786.6-14 | 3/1985 |
| EP | 0922530 A2 | 6/1999 |
| EP | 0922530 | 6/1999 |
| EP | 1219389 | 7/2002 |
| JP | 04057667 | 2/1992 |
| JP | 2001353654 | 12/2001 |
| WO | WO97/19785 | 6/1997 |

OTHER PUBLICATIONS

Search Results from German Patetn Appln 102 21 842.0.
European Search Report; EP 03003748.5.

* cited by examiner

*Primary Examiner*—Dung Van Nguyen
(74) *Attorney, Agent, or Firm*—Fulbright & Jaworski LLP

(57) ABSTRACT

In a method for the machine polishing of workpieces, the workpiece is immersed into a container filled with abrasive and is moved relative to the abrasive container. The workpiece is here moved up and down in the vertical direction, rotated about its own central axis and moved with its central axis inside the container.

24 Claims, 2 Drawing Sheets

POLISHING METHOD

CROSS REFERENCE TO RELATED APPLICATIONS

This application claims priority from German Application No. 102 21 842.0 filed May 16, 2002.

STATEMENT REGARDING FEDERALLY SPONSORED RESEARCH OR DEVELOPMENT

Not Applicable.

INCORPORATION-BY-REFERENCE OF MATERIAL SUBMITTED ON A COMPACT DISC

Not Applicable.

BACKGROUND OF THE INVENTION (1) Field of the Invention

The present invention relates to a method for the machine polishing of rotationally symmetrical workpieces, in particular vehicle rims, in which the workpiece is immersed into a container filled with a polishing medium and is moved relative to the polishing medium container.

(2) Description of Related Art Including Information Disclosed Under 37 CFR 1.97 and 1.98

Such methods for surface treatment are generally known. In them, the polishing medium container is filled with polishing members and detergent compositions in order to achieve an effective surface treatment.

Previous polishing methods admittedly make possible a polishing of a workpiece, or of a vehicle rim, up to a certain degree. Nevertheless, it is not possible with the known polishing methods to achieve a surface treatment or refine polishing such that the rim has the outward appearance of a chromium plated rim. Moreover, no effective working can take place in lower lying pockets or cutouts.

SUMMARY OF THE INVENTION

It is the object of the invention to provide a method and an apparatus for the machine polishing of workpieces with which the outward appearance of a chromium plated workpiece can be provided without a chromium plating being necessary.

This object is satisfied by the features of the independent claims and in particular by a method of the kind initially named in which the workpiece is simultaneously a) moved up and down in the container in the vertical direction; b) rotated about its own central axis; and c) is moved with its central axis along a closed orbit in the container.

In accordance with the invention, the workpiece, or the rim, is additionally subject to an orbital movement in addition to an oscillation movement and a rotational movement, that is the rim is moved with its central axis along a closed orbit in the container. It has been found here that excellent polishing results can be achieved by such a procedure in which the rim is only subjected to an oscillation in the vertical direction, but is subjected to an orbital movement in the horizontal direction. Since the rim does not carry out any oscillation movement in the horizontal direction, in which the direction of movement has to be reversed at an end point, a particularly uniform flow of the polishing members is achieved, whereby the rim can be polished so strongly that a chromium plated appearance can be achieved, with the surface of the workpiece being polished perfectly without disturbing contamination or residues and without "orange skin".

Advantageous embodiments of the invention are described in the description, in the drawing as well as in the dependent claims.

In accordance with a first advantageous embodiment, the central axis of the workpiece can be moved along an orbital path, for example a circular orbit, which has a diameter of approximately 10 to 35% of the diameter of the workpiece. It has namely been found that an orbital path with a relatively small diameter surprisingly leads to extremely good results, although the path of movement of the workpiece through the container filled with polishing medium is only comparatively short. An advantageous diameter of an orbital track can here be approximately 100 to 300 mm.

In accordance with a further advantageous embodiment of the invention, at least one stirring element is provided in the container and is set into rotation. The polishing effect can be additionally increased by such a stirring element in that the relative movement between the workpiece and the polishing members is enlarged. It is here particularly advantageous when the stirring element is rotated in the interior of the workpiece and/or beneath the workpiece. It is hereby possible, on the one hand, also to polish hidden part areas of the workpiece satisfactorily. A workpiece polished on both sides can be provided by such a method, on the other hand; for example a rim which can be used for motorcycles.

A particularly good polish effect results when the stirring element is rotated opposite to the rotational direction of the workpiece.

In accordance with a further advantageous embodiment, the workpiece can additionally have a nutating movement imposed on it in order to further increase the relative movement between the polishing medium and the workpiece.

In accordance with a further embodiment of the invention, a method for the machine polishing of workpieces is provided in which a workpiece, for example a rim, is immersed into a container filled with polishing medium and is moved relative to the polishing medium container, with the polishing method comprising the process steps A) rough polishing; B) fine polishing; and C) high gloss polishing. A chromium plated appearance of the polished rim can be achieved by such a three-step process, in particular when the initially described movement steps (oscillation, rotation and orbital movement) are carried out.

In accordance with a particularly advantageous embodiment, the rim can only not be oscillated during process step C), that is the rim is moved up and down in the vertical direction in the container during rough polishing and fine polishing, but not during high gloss polishing.

In accordance with a further embodiment of the method in accordance with the invention, it is advantageous to change the oscillation frequency of the vertical movement at least once, in particular to reduce it to at least 50%, during process steps A), B) and C). It can likewise be advantageous to change the minimum or maximum depth of immersion of the rim in the container at least once during process steps A), B) or C).

The polishing process in accordance with the invention can also be optimized by the use of selected polishing media. After numerous trials, the inventors have found that it can be particularly advantageous when the volume weight of the polishing medium used is selected to be larger in process step A) than in process step B), but smaller than in process step C).

Good results have also been able to be achieved in that the maximum speed of the rotational movement and of the orbital movement is selected to be lower than approximately 150 rpm.

In accordance with a further aspect of the present invention, it relates to an apparatus for the machine polishing of workpieces, with the apparatus comprising a polishing medium container and at least one chuck for the attachment of a workpiece. Furthermore, an oscillation device is provided which oscillates the polishing medium container or the chuck in the vertical direction. A rotational device and an orbital drive are furthermore provided to set the chuck into rotation about a central axis and to simultaneously move it along a closed orbital path. The initially named advantages result with such an apparatus.

In accordance with an advantageous embodiment, the chuck is attached to a vertical shaft, that is the rim is rotated about a vertically extending rotational axis in the polishing medium container. An unwanted wave formation, which disadvantageously influences the polishing process, can hereby be avoided in the polishing medium container.

An embodiment with a particular advantageous construction results when the orbital drive has a transmission which is coupled to the rotational device. In this manner, both the rotational movement and the orbital movement can take place with the help of a single drive. For example, a planetary transmission can be provided, with the planet gear transferring the rotational movement and a sun gear transferring the orbital movement.

In accordance with a further embodiment of the invention, at least one stirring element can be provided which is rotatably driven about a vertical axis. An increased relative movement is hereby effected between the polishing medium and the workpiece, on the one hand. An unwanted wave formation within the polishing medium is prevented by the vertically arranged rotational axis, on the other hand. The stirring element can here be arranged in the region of the chuck in order to achieve an upwardly extending inner region of the workpiece. Alternatively, or also additionally, the stirring element can be arranged in the region of the polishing medium container, for example above the container base.

A particularly simple construction results in an embodiment in which the stirring element is attached to a vertical shaft which extends coaxially, and preferably at the inside, relative to a shaft to which the chuck is attached.

It can be advantageous in individual process steps to oscillate and rotate the workpiece, but not to subject it to an orbital movement. In accordance with a further aspect of the invention, an apparatus for the machine polishing of workpieces is suitable for such a process step which comprises a polishing medium container, a chuck attached to a shaft for the attachment of at least one workpiece and an oscillation device which oscillates the polishing medium container or the chuck in the vertical direction. Furthermore, a rotational device is provided which sets the chuck into rotation about a central axis. A stirring element is attached to a vertical shaft which extends coaxially to the shaft at which the chuck is attached. The stirring element can be set into rotation beneath, or even within, the workpiece, for example a vehicle rim, by such an apparatus in order to achieve the desired polishing effects.

Even though the movement of the workpiece has been described above preferably relative to the polishing medium container, it is also assumed that it is generally unimportant for the invention whether the described movements are achieved by a movement of the workpiece or, alternatively, by a movement of the container. In the described embodiment, however, it is not the container, but only the rim which is moved, since this requires a lower effort in apparatus and construction.

It must be added that the method in accordance with the invention is generally suitable for all rotationally symmetrical workpieces, although the use of rims is preferred. All kinds of rims or wheels are possible here, i.e. rims for passenger motor vehicles, heavy goods vehicles or motorcycles in all sizes and variations.

The present invention will be described in the following purely by way of example with reference to an advantageous embodiment and to the enclosed drawing.

BRIEF DESCRIPTION OF THE DRAWINGS

There are shown.

DETAILED DESCRIPTION OF THE INVENTION

Figure 1:
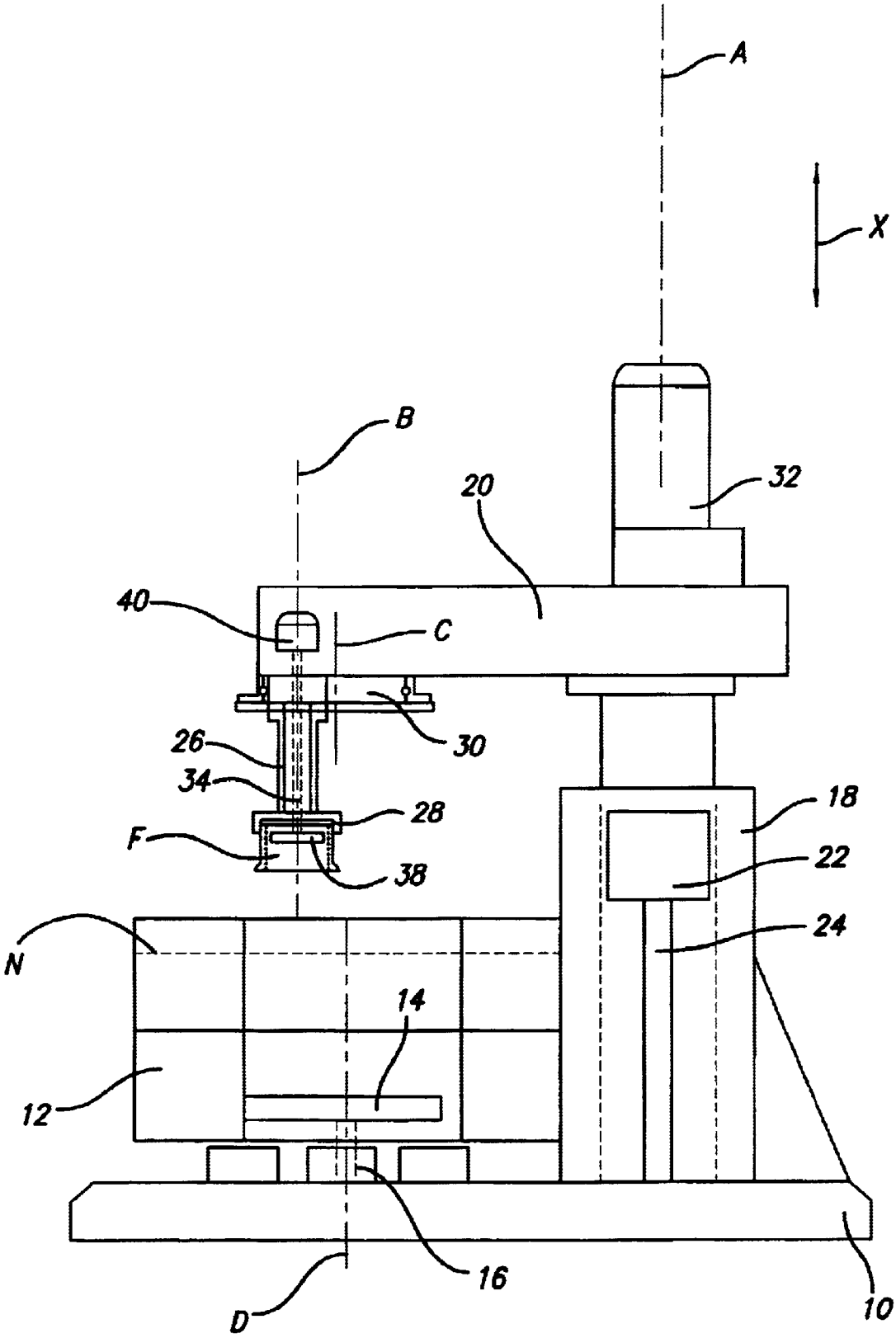
FIG. 1 is a side view of a first embodiment of a polishing apparatus.

The polishing apparatus shown in FIG. 1 has a base rack 10 on which a polishing medium container 12 is arranged. The polishing medium container 12 is round and upwardly open in the embodiment shown, but can also be trough shaped or tub shaped. The polishing medium container 12 is not in a fixed connection with the base rack 10 and can thus be exchanged without problem by floor conveying vehicles. A vibration drive can additionally be provided to increase the movement of the polishing medium. Furthermore, diverse inflow and outflow possibilities are provided at the polishing medium container 12 to add or remove water and/or treatment agents (compounds) continuously. In operation, the container 12 is filled with polishing medium approximately to the height of level N.

A stirring element 14 is provided at the base of the container 12 and has a plurality of paddles extending parallel to the base which are rotatingly driven about a vertical axis of rotation D via a drive 16 disposed beneath the container base. Furthermore, a machine stand 18 is arranged on the base rack 10 and a crossbeam 20 is displaceably attached to this in the vertical direction, that is along the double arrow X. The vertical movement is effected via a drive 22 which is not shown in more detail and which effects a raising and a lowering of the crossbeam 20 in conjunction with a stroke cylinder 24. The crossbeam is here raised or lowered along the axis A in the direction of the double arrow X. In the position shown in FIG. 1, the crossbeam 20 is in an upper position which corresponds to the loading and unloading position, that is the crossbeam 20 can be moved downwardly out of the position shown.

At the outer end of the crossbeam 20, a vertical hollow shaft 26 is provided at whose outer end a chuck 28 is mounted which serves for the attachment of a rim F. The hollow shaft 26 is here attached to a planetary transmission 30 which is driven via a drive 32 and via toothed belts (not shown). The hollow shaft 26, and thus the chuck 28 and thus also the rim F, are hereby rotated about their own central axis B via the drive 32, on the one hand. The rim F is guided in an orbital movement, on the other hand, with its central axis B along a closed orbital track, which is circular in the embodiment shown, about the central axis C of the planetary transmission 30. The drive 22 thus effects the oscillation movement of the rim F along the axis A in the direction of the double arrow 32 and the drive 32 effects both the rotational movement of the rim F about its central axis B and the orbital movement about the axis C.

A further shaft 34 is provided in the interior of the hollow shaft 26 and a stirring device 38 is secured to its lower end and dips into the interior of the rim F. A further drive 40 serves for the rotation of the stirring device 38 about the axis B.

As FIG. 1 shows, the rotational axis D, which is arranged approximately at the center of the container 12, extends coaxially to the axis of rotation C of the planetary transmission 30.

A manner of operation can here also be achieved by a corresponding blocking of the planetary transmission 30 in which the rim F admittedly rotates about the axis B, but does not carry out any orbital movement about the axis C. Such a manner of operation can prove to be advantageous in individual process steps. All drives 16, 22, 32 and 40 are speed regulated and reversible in their rotational direction. All drives are connected to a machine control (not shown) in which the desired work procedures can be programmed as desired.

In the aforesaid apparatus, the hollow shaft 26 has an offset of approximately 100 mm to the axis of rotation C.

Figure 2:
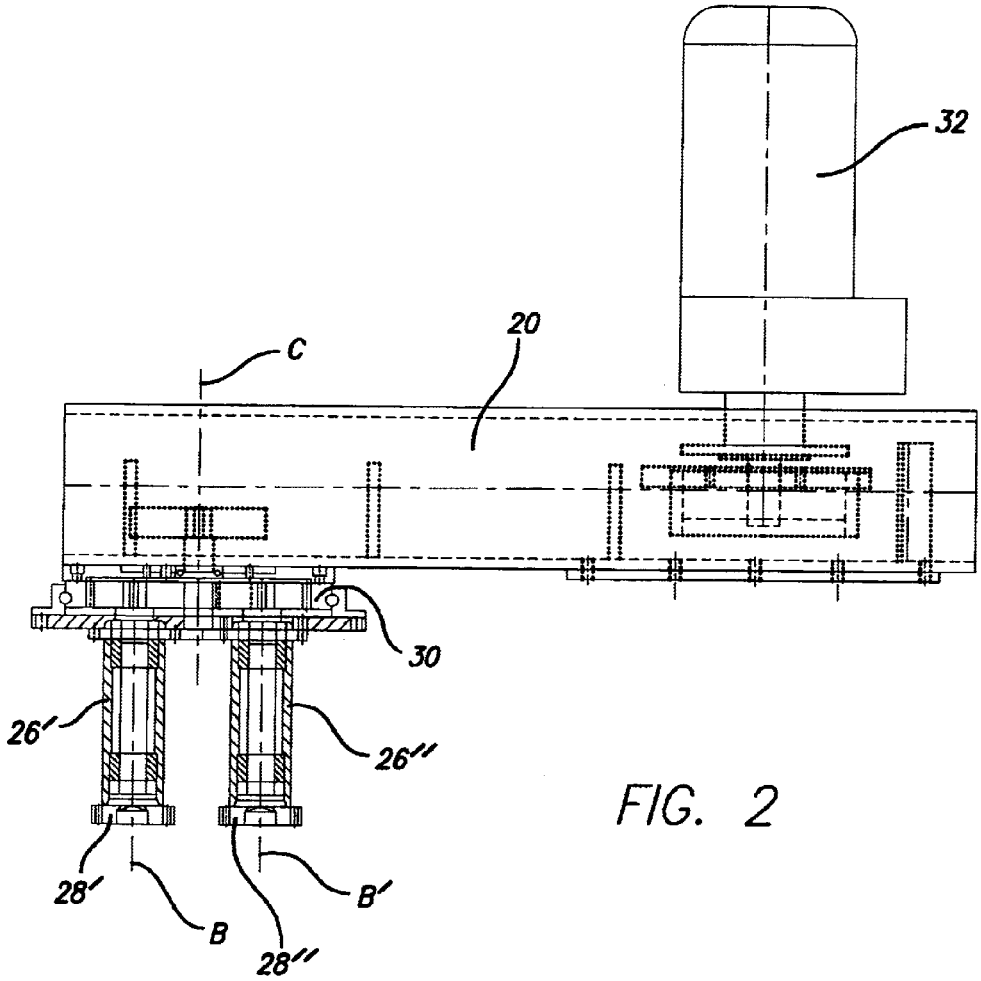
FIG. 2 is a part of a polishing apparatus in accordance with a further embodiment.

FIG. 2 shows a further embodiment of a polishing apparatus, with the same reference numerals being used for the same parts in comparison with FIG. 1.

In FIG. 2, the crossbeam 20 of a further embodiment of the polishing apparatus is shown which differs from the embodiment shown in FIG. 1 in that not only one chuck, but a plurality of chucks 28', 28" are attached in each case to hollow shafts 26', 26". The hollow shafts 26' and 26" are in turn attached to a planetary transmission 30 which is driven via the drive 32. The chucks 28' and 28" thus rotate about the central axis C of the planetary transmission 30 and additionally about the central axes B and B' of the hollow shafts 26' and 26".

The number of chucks which are moved along an orbital path by the planetary transmission is naturally generally not limited.

The polishing method in accordance with the invention will be described in the following with reference to the polishing apparatus of FIG. 1, said polishing method generally comprising the process steps A) rough polishing, B) fine polishing and C) high gloss polishing.

All data here refer to the product names of the company of Rosier Oberflachentechnik GmbH, Staffelstein, Germany, with respect to the polishing members and the compounds.

A) Rough Polishing

In this first process step, polishing members of the type TP/S with a volume weight of approximately 1.82 g/cm$^3$ are used. The bulk weight of the polishing medium amounts to approximately 1.0 to 1.31, in particular 1.25 kg/l. Polishing members of a pyramid shape are preferably used. However, conical, parabolic, triangular and double V shapes are also possible individually or in a mixture. The polishing means can consist of plastic or of a ceramic material. FCAL232 as well as water are used as the compound material.

The container 12 is filled with TP/S polishing members for rough polishing. The filling level of the polishing members should preferably reach the upper edge of the rim to be immersed. 100 l water per hour and 1.2 l FCAL232 are added in during the processing.

The polishing time can vary between approximately 10 and 60 minutes. Rough polishing preferably takes place in the following two steps:

1st Step:

The rim F clamped into the chuck 28 with its visible side facing down and is moved about the axes B and C at a speed of 100 rpm. Subsequently, the rim F is moved into the container 12 and moved up and down through approximately 24 strokes per minute within the polishing members. The immersion depth varies here between approximately 70 mm and 170 mm. The processing time amounts to between 16 and 34 min depending on the casting quality of the aluminum rim F, with preferably 50% leftward movement and 50% rightward movement taking place.

2nd Step:

In this second process step of rough polishing, the aforesaid process parameters are varied as follows: the immersion depth amounts to 90 to 190 mm and the speed of the rim amounts to 25 rpm. 3 to 4 strokes per minute are carried out, with the processing time preferably amounting to approximately 6 min with 3 min rightward movement and 3 min leftward movement in each case.

B) Fine Polishing

In this second process step, a mixture of TP/FS with the aforesaid shapes and sizes between 0 and 25 mm is used as the polishing medium. The volume weight of the polishing members amounts to approximately 1.6 g/cm$^3$. The bulk weight of the polishing medium amounts to approximately 0.85 to 1.22, in particular 1.03 kg/l. Again, FCAL232 (2.5 l/h) and water (150 l/h) is used as the compound. The processing time amounts to approximately 12 to 25 minutes.

The process time of fine polishing is divided into the following two process steps:

1st Step:

The finishing process is here generally similar to the aforesaid rough polishing, that is the speed of the rim F amounts to approximately 100 rpm at 20 strokes per min. The immersion depth of the rim within the polishing members amounts to approximately 70 to 170 mm. The processing time amounts to approximately 10 min, with 4 min rightward movement and 4 min leftward movement in each case.

2nd Step:

In this second method step, the speed of the rim amounts to approximately 25 to 34 rpm at 20 strokes per min. The immersion depth varies between 90 and 190 mm. The processing time amounts to 6 min with 3 min rightward movement and 3 min leftward movement in each case.

C) High Gloss Polishing

In this last process step, TP/PL 5,6 GP with a volume weight of approximately 2.4 g/cm$^3$ is used as the polishing members. The bulk weight of the polishing medium amounts to approximately 0.65 to 4.91, in particular 1.51 kg/l. FCAL232 together with water is used as the compound. The filling level of the polishing members corresponds to the water level in the container. Expediently, an increased liquid level is set here, whereby the polishing members flow well around the workpieces. At the same time, an optimum brightening and polishing is achieved. Water is added in at 20 to 30 l/h and compound at approximately 1.5 l/h during the processing. A two-stage processing also takes place here:

1st Step:

In this process step, the planetary transmission 30 is blocked such that a rotation of the rim F only takes place about the axis B, but no orbital movement about the axis C. The speed here amounts to approximately 60 to 80 rpm at 10 to 15 strokes/min. The immersion depth amounts to between approximately 95 and 155 mm. The processing time amounts to approximately 14 min with 3 min rightward movement and 3 min leftward movement in each case.

2nd Step:

Here, the speed is selected to be approximately 25 to approximately 35 rpm at 10 to 15 strokes/min. The immersion depth amounts to approximately 55 to 155 mm. The processing time amounts to approximately 8 min, with 2 min rightward movement and 2 min leftward movement in each case.

Subsequent to the process step C) of high gloss polishing, the application of a corrosion protection and/or of a lacquer can follow which does not change the visual properties of the rim.

A different aggressiveness of the polishing medium can be effected by a continuous change in the process water level.

What is claimed is:

1. A method for the machine polishing of a rotationally symmetrical workpiece in which the workpiece is immersed into a container filled with a polishing medium and is moved relative to the polishing medium container, with the workpiece simultaneously:

a) being moved periodically up and down in the vertical direction in the container (oscillation), the oscillation occurring during polishing;

b) being rotated about its own central axis (rotation); and c) being moved with its central axis along a closed orbital track in the container (orbital movement).

2. A method in accordance with claim 1, characterized in that the central axis of the workpiece is moved along an orbital track which has a diameter of approximately 10–35% of the diameter of the workpiece.

3. A method in accordance with claim 2, characterized in that the central axis of the workpiece is moved along an orbital track which has a diameter of approximately 100–300 mm.

4. A method in accordance with claim 1, characterized in that the workpiece additionally has a nutating movement imposed on it.

5. A method in accordance with claim 1, characterized in that the maximum speed of the rotational movement and of the orbital movement is selected to be lower than approximately 150 rpm.

6. A method in accordance with claim 1, characterized in that the polishing medium includes liquid; and in that the liquid level is changed continuously.

7. A method in accordance with claim 1, in which the rotationally symmetrical workpiece is a vehicle rim.

8. A method for the machine polishing of a rotationally symmetrical workpiece in which the workpiece is immersed into a container filled with a polishing medium and is moved relative to the polishing medium container, with the workpiece simultaneously:

a) being moved up and down in the vertical direction in the container (oscillation), the oscillation occurring during polishing;

b) being rotated about its own central axis (rotation); and c) being moved with its central axis along a closed orbital track in the container (orbital movement), and at least one stirring element is provided in the container and is set into rotation.

9. A method in accordance with claim 8, characterized in that the stirring element is rotated in the interior of the workpiece and/or beneath the workpiece.

10. A method in accordance with claim 8, characterized in that the stirring element is rotated opposite to the direction of rotation of the workpiece.

11. A method for the machine polishing of a rotationally symmetrical workpiece in which the workpiece is immersed into a container filled with a polishing medium and is moved relative to the polishing medium container, with the workpiece simultaneously:

a) being moved up and down in the vertical direction in the container (oscillation), the oscillation occurring during polishing;

b) being rotated about its own central axis (rotation); and c) being moved with its central axis along a closed orbital track in the container (orbital movement), wherein the polishing comprises the following process steps:

A) rough polishing;

B) fine polishing;

C) high gloss polishing.

12. A method in accordance with claim 11, characterized in that the workpiece is not oscillated only during one process step, in particular during process step C).

13. A method in accordance with claim 11, characterized in that the oscillation frequency and/or the rotational speed is changed at least once, is in particular reduced to at least approximately 50%, during the process steps A), B) and C).

14. A method in accordance with claim 11, characterized in that the minimum or the maximum immersion depth of the workpiece in the container is changed at least once during the process steps A), B) or C).

15. A method in accordance with claim 11, characterized in that the volume weight of the polishing medium used in process step A) is selected to be larger than in process step B), but smaller than in process step C).

16. A method in accordance with claim 11, characterized in that the bulk weight of the polishing medium used in process step A) is selected to be larger than in process step B), but smaller than in process step C).

17. A method in accordance with claim 11, characterized in that the bulk weight of the polishing medium used lies in the range from approximately 1.0 to 1.3 kg/l in process step A); in the range from approximately 0.8 to 1.3 kg/l in process step B); and in the range from approximately 0.5 to 5 kg/1 in process step C).

18. An apparatus for the machine polishing of workpieces, comprising a polishing medium container (12);

at least one chuck (28, 28', 28") for the attachment of at least one workpiece (F);

an oscillation device (22) which oscillates the polishing medium container (12) or the chuck (28, 28', (28") for periodic movement in the vertical direction (X);

a rotational device (30, 32) which sets the chuck (28, 28', 28") into rotation about a central axis (B, B'); and an orbital drive (30, 32) which moves the chuck (28, 28', 28") along a closed orbital path.

19. An apparatus in accordance with claim 18, characterized in that the chuck (28, 28', 28") is attached to a vertical shaft (26, 26', 26").

20. An apparatus in accordance with claim 18, characterized in that it has at least one stirring element (14, 38) which is rotatably driven about a vertical axis (B, B', D).

21. An apparatus in accordance with claim 20, characterized in that the stirring element (14, 38) is arranged in the region of the chuck (28, 28', 28") and/or in the region of a polishing medium container (12).

22. An apparatus in accordance with claim 20, characterized in that the stirring element (38) is attached to a vertical shaft (34) which extends coaxially to a shaft (26) to which the chuck (28) is attached.

23. An apparatus for the machine polishing of workpieces, comprising a polishing medium container (12);

at least one chuck (28, 28', 28") for the attachment of at least one workpiece (F);

an oscillation device (22) which oscillates the polishing medium container (12) or the chuck (28, 28', (28") for periodic movement in the vertical direction (X);

a rotational device (30, 32) which sets the chuck (28, 28', 28") into rotation about a central axis (B, B'); and an orbital drive (30, 32) which moves the chuck (28, 28', 28") along a closed orbital path wherein the orbital drive has a transmission (30) which is coupled to the rotational device (32).

24. An apparatus for the machine polishing of workpiece, comprising a polishing medium container (12);

a chuck (28) attached to a shaft (26) for the attachment of at least one workpiece (F);

an oscillation device (22) which oscillates the polishing medium container (12) or the chuck (28) in the vertical direction (X);

a rotational device (30, 32) which sets the chuck (28) into rotation about a central axis (B); and a stirring element (38) which is attached to a vertical shaft (34) which extends coaxially to the shaft (26) to which the chuck (28) is attached.

* * * * *